US011578493B2

(12) United States Patent
Villette et al.

(10) Patent No.: US 11,578,493 B2
(45) Date of Patent: Feb. 14, 2023

(54) MECHANICAL COUPLINGS FOR REINFORCING BARS

(71) Applicant: SAUDI ARABIAN OIL COMPANY, Dhahran (SA)

(72) Inventors: Thibault Villette, Belfort (FR); Waleed Al Nasser, Ad Dammam (SA); Abdullatif Jazzar, Khobar (SA); Abderrazak Traidia, Lussan (FR)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/362,527

(22) Filed: Jun. 29, 2021

(65) Prior Publication Data

US 2022/0412090 A1 Dec. 29, 2022

(51) Int. Cl.

| | |
|---|---|
| ***E04C 5/16*** | (2006.01) |
| ***E04C 5/07*** | (2006.01) |
| ***E04C 5/12*** | (2006.01) |

(52) U.S. Cl.

CPC ..... *E04C 5/163* (2013.01); *E04C 5/073* (2013.01); *E04C 5/125* (2013.01); *E04C 5/127* (2013.01)

(58) Field of Classification Search

CPC ..... E04C 5/125; E04C 5/127; E04C 5/163; E04C 5/165; E04C 5/073

See application file for complete search history.

(56) References Cited

U.S. PATENT DOCUMENTS

| | | | | |
|---|---|---|---|---|
| 1,003,973 A * | 9/1911 | Barrickman | ..... | E04B 1/2604 403/340 |
| 1,331,776 A * | 2/1920 | Lewis | ..... | E21B 17/046 403/331 |
| 3,617,078 A * | 11/1971 | Valukonis | ..... | F16B 7/22 403/341 |
| 3,679,250 A | 7/1972 | Marsden | | |

(Continued)

FOREIGN PATENT DOCUMENTS

| | | |
|---|---|---|
| CN | 211473089 U | 9/2020 |
| DE | 40 18 042 A1 | 12/1991 |

(Continued)

OTHER PUBLICATIONS

ASTM International, "Standard Specification for Solid Round Glass Fiber Reinforced Polymer Bars for Concrete Reinforcement"; Designation: ASTM D7957/D7957M-17; pp. 1-5; 2017 (5 pages).

(Continued)

*Primary Examiner* — Jessie T Fonseca

(74) *Attorney, Agent, or Firm* — Osha Bergman Watanabe & Burton LLP

(57) ABSTRACT

There is disclosed a mechanical coupling for two rebars. The coupling includes a first extremity disposed on a first of the two rebars, and a second extremity disposed on a second of the two rebars. Each of the first and second extremities are machined to effect an interlocking, form-fit connection between the two rebars, wherein the form-fit connection prevents separation of the extremities and inhibits axial displacement of the two rebars with respect to each other. The coupling further includes a covering disposed about the two extremities when the extremities are interconnected via the interlocking, form-fit connection. Also disclosed and described is a related method.

13 Claims, 7 Drawing Sheets

(56) References Cited

U.S. PATENT DOCUMENTS

| | | | | |
|---|---|---|---|---|
| 3,850,535 | A | 11/1974 | Howlett et al. | |
| 4,127,354 | A | 11/1978 | Mixon, Jr. | |
| 4,143,986 | A | 3/1979 | Antosh | |
| 4,469,465 | A | 9/1984 | Andrus | |
| 5,098,216 | A * | 3/1992 | Caperton | F16B 7/22 403/286 |
| 5,193,932 | A * | 3/1993 | Wu | E04C 5/165 403/307 |
| 5,407,292 | A * | 4/1995 | Collins | E21B 17/04 403/320 |
| 5,439,309 | A * | 8/1995 | Raz | E04B 1/1903 403/316 |
| 5,491,941 | A * | 2/1996 | Lancelot, III | E04C 5/163 52/223.1 |
| 5,681,126 | A | 10/1997 | Lin | |
| 5,919,205 | A * | 7/1999 | Heimberger | A61B 17/29 606/205 |
| 5,967,691 | A | 10/1999 | Lancelot, III | |
| 6,265,065 | B1 * | 7/2001 | McCallion | B29C 63/42 174/394 |
| 2003/0231925 | A1 * | 12/2003 | Chen | F16B 5/0052 403/294 |
| 2007/0175167 | A1 | 8/2007 | Allen et al. | |
| 2009/0145074 | A1 * | 6/2009 | Tsukamoto | E04C 5/0604 52/686 |
| 2010/0031607 | A1 | 2/2010 | Oliva et al. | |
| 2011/0308198 | A1 * | 12/2011 | Comerford | B21F 15/08 52/848 |
| 2013/0028658 | A1 | 1/2013 | Yee | |
| 2014/0010590 | A1 * | 1/2014 | Stewart | C21D 9/0075 403/345 |
| 2016/0208492 | A1 | 7/2016 | Kim | |

FOREIGN PATENT DOCUMENTS

| | | | |
|---|---|---|---|
| EP | 2 756 142 | A1 | 7/2014 |
| KR | 10-1221322 | B1 | 1/2013 |

OTHER PUBLICATIONS

Aly, Ragi et al., "Tensile Lap Splicing of Fiber-Reinforced Polymer Reinforcing Bars in Concrete"; ACI Structural Journal; vol. 103, Issue 6, Title No. 103-S87; pp. 857-864; Nov.-Dec. 2006 (8 pages).

Yuan, Guoqing et al., "A Review on the Connection of FRP Bars"; Applied Mechanics and Materials; vol. 238; pp. 61-65; Nov. 29, 2012 (5 pages).

ACI Committee 440, "Guide for the Design and Construction of Structural Concrete Reinforced with Fiber-Reinforced Polymer (FRP) Bars"; ACI 440.1R-15; pp. 1-83; Mar. 2015 (88 pages).

Moment, "Mechanical Splices Vs Lap Splicing"; May 8, 2018; <https://www.moment-solutions.com/mechanical-splices-vs-lap-splicing/>; Accessed Jun. 15, 2020 (6 pages).

Ebnesajjad, Sina, "Characteristics of Adhesive Materials"; Handbook of Adhesives and Surface Preparation; Technology, Applications and Manufacturing, Plastics Design Library; Chapter 8; pp. 137-183; 2011 (47 pages).

Yuan, G. et al., "Study of Coaxial FRP Sleeve / Expansion Cement Connection of FRP Rebars"; Proceedings of the 18th International Conference on Composite Materials; Aug. 21-26, 2011 (4 pages).

ERICO International Corporation, "In-Situ Rebar Splice meets Ultimate Splice requirements."; Apr. 29, 2008; <https://news.thomasnet.com/fullstory/in-situ-rebar-splice-meets-ultimate-splice-requirements-543651>; Accessed Mar. 14, 2021 (5 pages).

Concrete Reinforcing Steel Institute, "Splicing Bar"; <https://www.crsi.org/index.cfm/steel/splices>; Accessed Mar. 14, 2021 (5 pages).

Lancelot, Harry B., "Mechanical splices of reinforcing bars", Concrete Construction; Jan. 1, 1985 (5 pages).

ACI Committee 439, "Mechanical Connections of Reinforcing Bars", International Concrete Abstracts Portal, Technical Documents; ACI 439.3R-91; pp. 439.3R-1-439.3R-16; 1999 (16 pages).

Dayton Superior, "Rebar Splicing Handbook"; Concrete Construction Products; Jul. 2018 (72 pages).

* cited by examiner

MECHANICAL COUPLINGS FOR REINFORCING BARS

BACKGROUND

Reinforced concrete is very frequently employed in large-scale construction projects, such as roads, bridges, large buildings and containers for hazardous materials. Reinforcing bars, or "rebars", set within the concrete are used to compensate for inherent weaknesses of concrete in tension. Typically, the rebars have a similar coefficient of thermal expansion as the surrounding concrete, to avoid or mitigate any internal thermal stresses.

Typically, rebars are formed from untreated carbon steel, which is vulnerable to corrosion from a variety of sources include salts such as sodium chloride (e.g., which itself may derive from a maritime environment or the use of deicing salts). Thus, steel rebars may require surface treatment prior to installation, adding unneeded complexity. Further, their general use may be limited or even proscribed in some specific applications (e.g., in hospitals with Magnetic Resonance Imaging (MRI) facilities). For these and other reasons, the use of non-metallic materials in rebars, such as a fiber reinforced polymer (FRP) in rebars has gained traction.

Generally, FRP and other non-metallic rebars present significant advantages for builders and constructors when compared to steel rebars. However, there still remain challenges in the course of their everyday, practical use. For instance, a cumbersome process is frequently encountered when joining FRP or other non-metallic rebars end-to-end, whether in a context of pre-cast (or modular) concrete panels, or cast-in-place concrete at a work site. Conventional arrangements present problems such as rebar cage congestion, corrosion, and over-reliance on transferring tensile forces through the concrete rather than through the rebars themselves. As such, there is a need for a quick and reliable manner of joining together FRP (or other non-metallic) rebars.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a mechanical coupling for two rebars. The coupling includes a first extremity disposed on a first of the two rebars, and a second extremity disposed on a second of the two rebars. Each of the first and second extremities are machined to effect an interlocking, form-fit connection between the two rebars, wherein the form-fit connection prevents separation of the extremities and inhibits axial displacement of the two rebars with respect to each other. The coupling further includes a covering disposed about the two extremities when the extremities are interconnected via the interlocking, form-fit connection.

In one aspect, embodiments disclosed herein relate to a method which includes: obtaining two rebars; and machining an extremity on each of the two rebars to effect an interlocking, form-fit connection between the two rebars, wherein the form-fit connection prevents separation of the extremities and inhibits axial displacement of the two rebars with respect to each other. The method further includes: interconnecting the rebar extremities via the interlocking, form-fit connection; and thereafter disposing a covering about the rebar extremities.

In one aspect, embodiments disclosed herein relate to a mechanical coupling for two FRP rebars. The coupling includes a first extremity disposed on a first of the two FRP rebars, and a second extremity disposed on a second of the two FRP rebars. Each of the first and second extremities are machined to effect an interlocking, form-fit connection between the two FRP rebars, wherein the form-fit connection prevents separation of the extremities and inhibits axial displacement of the two FRP rebars with respect to each other. The coupling further includes a non-metallic sleeve disposed about the two extremities when the extremities are interconnected via the interlocking, form-fit connection, wherein the sleeve is formed from a material which is stronger than a material forming each of the first and second rebars. Additionally, the coupling includes one or more clamping elements which clamp the sleeve about the first and second extremities. When clamped, the sleeve absorbs the majority of a tensile load applied to the first and second rebars.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
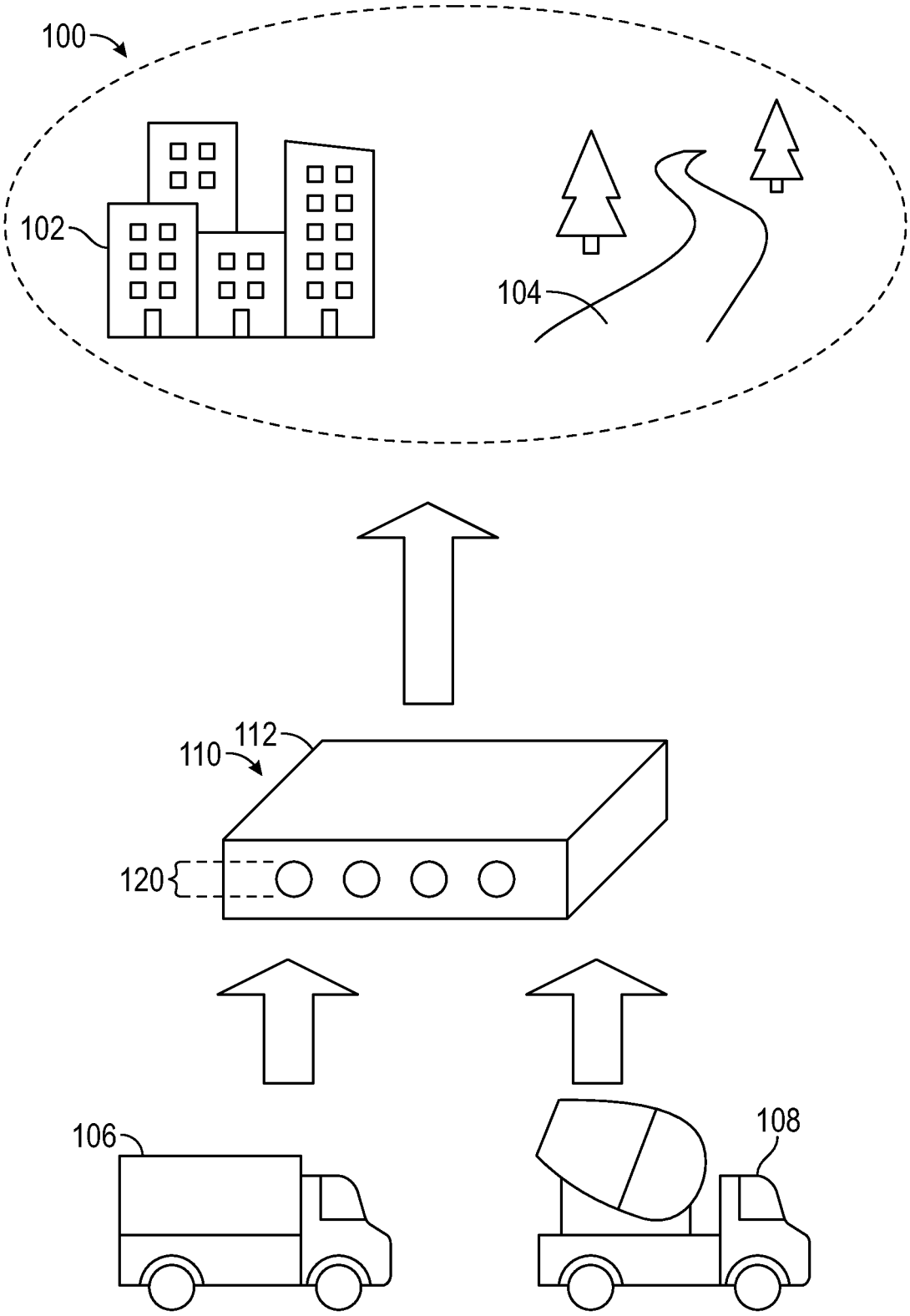
FIG. 1 schematically illustrates a reinforced concrete portion and associated applications, in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Broadly described and contemplated herein, in accordance with one or more embodiments, are systems and methods for effecting a mechanical coupling of two FRP (or other non-metallic) rebars. Loads are predominantly transferred via a mechanical coupling, and not via surrounding concrete.

In accordance with one or more embodiments, the mechanical coupling is provided in part via a simple machining of the extremities of rebars. The machining permits and effects an interlocking, form-fit connection directly between two rebars, wherein the connection prevents separation of the extremities and inhibits axial displacement of the rebars with respect to each other. When interconnected, the rebar extremities may be covered (e.g., surrounded) by a covering disposed thereabout (e.g., about a region of interconnection of the two rebars). The covering may be embodied by a light, high-strength tubular sleeve, and the assembly (including the interlocking rebar extremities) may be clamped via one or more cable ties or other fasteners. A quickly established, simple construction of a mechanical coupling is thereby provided. Further, the mechanical coupling offers a "synergistic" combination of a strong, clamped connection which facilitates the transfer of tensile/axial loads mainly via the covering, and a physical, form-fit interlocking connection of the rebar extremities themselves, serving a function of inhibiting axial displacement of the extremities relative to one another.

Rebars are generally formed from a metallic material and are often crudely interconnected at best. Typically, two rebar extremities are mutually positioned via "lap splicing", or the mere side-by-side positioning of the extremities, whether directly adjacent (involving physical contact) or not, and whether directly interconnected (e.g., via one or more surrounding loops or bands) or not. In such arrangements, tensile loads are transferred via the surrounding concrete, which greatly complicates the related structural design. For instance, a specific concrete grade would usually need to be chosen, and the extra rebar length needed (for side-by-side lap splicing) will make the structure heavier and increase congestion as the ratio of rebar weight to concrete weight becomes too high.

In accordance with one or more embodiments, using a mechanical coupling of the rebars results in a significant increase in structural integrity as the coupler assembly, including a tubular sleeve portion and clamps or fasteners, ends up absorbing a great majority of associated tensile loads, in a strictly axial direction. In comparison with lap splicing for conventional metallic rebars, the length of interconnection may also be reduced by a significant factor.

In accordance with one or more embodiments, the fasteners may be embodied by at least two clamping clips or cable ties which each constrict about the tubular sleeve. For their part, the rebar extremities may be machined on-site (e.g., at a building or highway construction site), or could be machined then included in a modular concrete component (e.g., a concrete slab or beam). Such machining may impart three-dimensional, mutually engaging "male-female" structural patterns to the extremities, which upon interconnection, permit the two rebars to remain coaxial with respect to one another.

Generally, in accordance with one or more embodiments, the machined (e.g., male/female) interconnection of the rebar extremities serves a physical "anti-slip" function, while absorbing a small portion of a tensile load applied to the rebars. At the same time, the coupler assembly (including the tubular sleeve and fasteners) serves a role of absorbing the great majority of a tensile load.

Turning now to the figures, to facilitate easier reference when describing FIGS. 1 through 7, reference numerals may be advanced by a multiples of 100 in indicating a similar or analogous component or element among FIGS. 1-7.

FIG. 1 schematically illustrates a reinforced concrete portion and associated applications, in accordance with one or more embodiments. Generally, reinforced concrete may find a huge variety of applications 100, including in the construction or repair of buildings 102 or of roads or highways 104, as shown for example in FIG. 1. Whether pre-cast as a modular element (e.g., a "slab") and delivered by a truck 106, or cast-in-place at the construction site via a cement mixer 108 (or analogously functioning equipment), a portion of reinforced concrete 110 may include poured/set concrete 112 with rebars 120 embedded therein. Those skilled in the art will appreciate that various suitable manners of positioning rebars within a mold for poured concrete, and of pouring and setting concrete such that the rebars are embedded within the concrete, are generally well-known and will not be described in further detail herein.

Figure 2A:
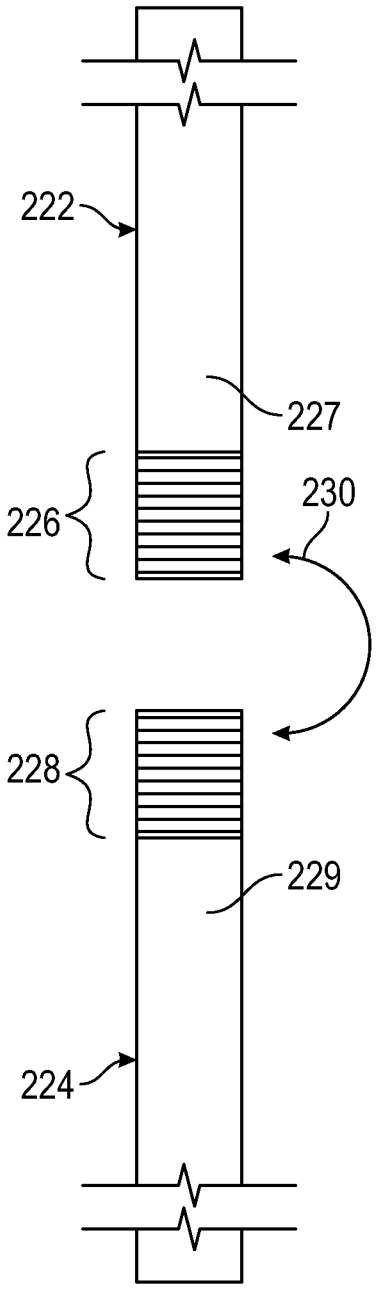
FIG. 2A schematically illustrates two rebars with machined extremities, in accordance with one or more embodiments.

FIG. 2A schematically illustrates two rebars with machined extremities, in accordance with one or more embodiments. As shown, at free ends thereof, a first rebar 222 and a second rebar 224 each include extremities 226 and 228, respectively. The rebars may be non-metallic, and particularly may be formed from a FRP material. The extremities 226 and 228 may be understood as a limited length of a respective free end of each rebar 222, 224 with physical features which are distinct from a main body portion (227 and 229, respectively) of each rebar 222, 224, and which are employed in a mechanical coupling of the rebars 222, 224.

As such, in accordance with one or more embodiments, the first and second extremities 226, 228 are machined to effect an interlocking, form-fit connection between the two rebars 222, 224. The form-fit connection prevents separation of the extremities and inhibits axial displacement of the rebars with respect to each other. The extremities 226 and 228 may be brought into connection with each other (see 230) essentially from a side-to-side or radial orientation, or any other orientation that is not necessarily strictly axial.

In accordance with one or more embodiments, the FRP material which may be employed for rebars 222, 224, may be a glass fiber-reinforced material. However, other types of fiber reinforcement may be employed for the FRP material, such as reinforcement via basalt fibers, aramid fibers, carbon fibers or even polymer fibers (e.g., PET [Polyethylene Terephthalate], UHMWPE [Ultra-High Molecular Weight Polyethylene] and polypropylene, among other possibilities). Depending on the material used, dimensions and properties for ancillary components such as a covering/sleeve and clamping elements (see, e.g., 234 and 236 in FIG. 2C) may be tailored to best work with the FRP rebar material at hand.

Figure 2B:
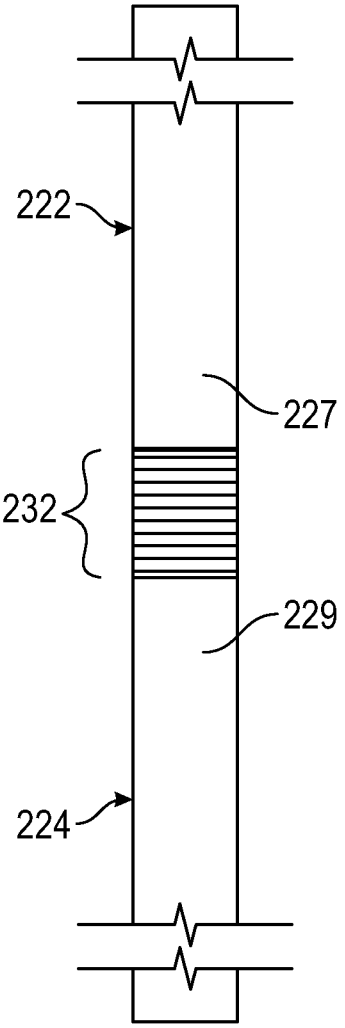
FIG. 2B schematically illustrates the two rebars of FIG. 2A, interconnected via a mechanical coupling, in accordance with one or more embodiments.

FIG. 2B schematically illustrates the two rebars of FIG. 2A, interconnected via an interlocking, form-fit connection, in accordance with one or more embodiments. As such, FIG. 2B shows the rebars 222, 224 connected through a region of interconnection 232 where the extremities 226, 228 (from FIG. 2A) are physically engaged with each other in an interlocking, form-fit connection. Further, the region of interconnection 232 may have a substantially constant outer diameter, which itself may be substantially equivalent to an outer diameter of the main body portions 227, 229 of each of the first and second rebars 222, 224. Additionally, the first and second extremities 226, 228 (see FIG. 2A) may be coaxial with respect to one another through the region of interconnection 232. As such, and in a manner to be better appreciated in accordance with one or more embodiments described and illustrated herein, the form-fit connection can prevent separation of the extremities 226, 228 and inhibit axial displacement of the two rebars 222, 224 with respect to each other. The region of interconnection 232 does not have any steel, which eliminates the risk of corrosion and electro-magnetic interference for certain applications, e.g., in hospitals.

Figure 2C:
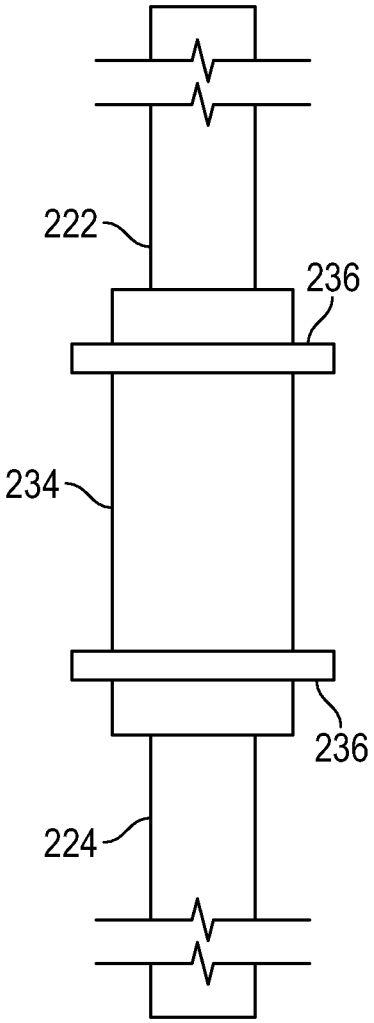
FIG. 2C schematically illustrates the interconnection of two rebars from FIG. 2B, with a covering disposed about a region of interconnection of the rebar extremities, in accordance with one or more embodiments.

FIG. 2C schematically illustrates the interconnection of the two rebars from FIG. 2B, with a covering 234 disposed about the rebar extremities (226, 228 from FIG. 2A), in accordance with one or more embodiments. Thus, covering 234 is disposed about the region of interconnection 232 (shown in FIG. 2B) when the extremities are interconnected via the interlocking, form-fit connection.

In accordance with one or more embodiments, the covering 234 may be embodied by a tubular sleeve, itself formed from material (e.g., non-metallic) which is stronger than that of the rebars 222, 224 themselves. Covering 234 may be generally cylindrical in shape, with an annular cross-section dimensioned to surround the region of interconnection 232 (shown in FIG. 2B). Additionally, clamping elements 236 may be provided for clamping the covering (e.g., sleeve) 234 about the region of interconnection 232 (shown in FIG. 2B), wherein a constricting force (e.g., a predetermined or prescribed tightening force) is applied radially inwardly via the covering 234. Clamping elements 236 may be embodied by cable ties or other types of fasteners which are structurally capable clamping about, or surrounding (fully or at least in part) the covering 234 and applying the aforementioned constricting force. Two such clamping elements 236 are shown in FIG. 2C, physically separated to an extent deemed suitable or advantageous. Alternatively, it is possible to utilize more than two such elements 236, or even just one. Also, when clamped, and in a manner to be better understood herebelow, the covering (e.g., sleeve) 234 may absorb a majority of a tensile load applied to the first and second rebars 222, 224; for instance, the covering 234 may absorb between about 70% and about 90% of the tensile load, while the interconnected rebar extremities (226, 228 from FIG. 2A) may absorb the remaining portion of the tensile load, or between about 10% and about 30%. It can further be appreciated that the covering 234 may inhibit or prevent transverse (radial) slippage of the two rebars 222, 224 with respect to one another, or further assist in preventing separation of the extremities (226, 228 from FIG. 2A).

In accordance with one or more embodiments, the covering 234 may be formed from a light, strong composite material, e.g., an FRP material, e.g., reinforced with high modulus fibers such as carbon, aramid or even Ultra-High Molecular Weight Polyethylene (UHMWPE) fibers. The clamping elements 236 may be embodied by two or more clamping clips or loops which, e.g., may be primarily nonmetallic with steel wire reinforcement. In this respect, the clamping clips or loops permit a tightening of the covering 234 with respect to the two rebars 222, 224 via applying the radially inwardly constricting force as mentioned. The constricting force thus mechanically connects the rebar extremities 226, 228 (see FIG. 2A) with the covering 234, to effect a transfer of the great majority of a tensile load on the rebars 222, 224 to the covering 234. Accordingly, the covering 234 can act as a stress bridge, protecting the interlocked rebar extremities from high tensile loads.

In accordance with one or more embodiments, in order to help ensure a durable tightening force which avoids creep and relaxation, continuous reinforcement may be used within the clamping elements 236 such as continuous glass, carbon, or steel fibers. If steel reinforcement is chosen, the steel wires may be fully embedded (e.g., over-molded) in a resin matrix so as to prevent corrosion. (If there are concerns about electromagnetic compatibility in a facility where it may be a concern, it is not expected that the very low amount of steel wire would appreciably cause any issues.)

In accordance with one or more embodiments, and with continued reference to FIGS. 2A-2C, the covering 234 may be placed into position in essentially any manner deemed suitable. For instance, it may be slid onto solely one of the rebars 222, 224 until the two rebar extremities 226, 228 are interconnected, then it may be slid axially to cover the rebar extremities 226, 228 (and the region of interconnection 232). The clamping elements 236 may then be applied as discussed heretofore. Optionally, a high-strength glue such as thermosetting or thermoplastic adhesive may be applied to help the covering 234 adhere to the rebars 222, 224, prior to (or during) the covering 234 being displaced or slid to cover the two extremities 226, 228. Those skilled in the art will readily appreciate that the overall design may be tailored or optimized, as deemed suitable, by employing any of a great variety of physical patterns for the physically interlocking rebar extremities 226, 228, adjusting the thickness of the covering 234, and decreasing or increasing the number and width (along an axial direction of the rebars 222, 224) of the clamping elements 236.

The disclosure now turns to working examples of a mechanical coupling in accordance with one or more embodiments, as described and illustrated with respect to FIGS. 3A-6. It should be understood and appreciated that these merely represent illustrative examples, and that a great variety of possible implementations are conceivable within the scope of embodiments as broadly contemplated herein.

Figure 3A:
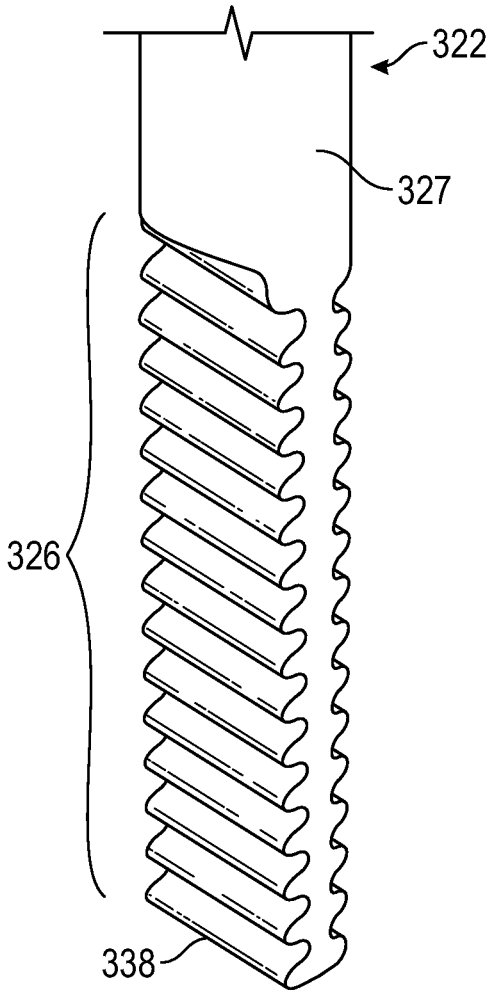
FIG. 3A provides an isometric elevational view of a working example of a first rebar, in accordance with one or more embodiments.

FIG. 3A provides an isometric elevational view of a working example of a first rebar 322, in accordance with one or more embodiments. As shown, first rebar 322 includes a machined extremity 326 characterized primarily by a projection (or male portion) 338. Projection 338, as shown, extends longitudinally away from a main body portion 327 of the first rebar 322. Generally, projection 338 is embodied as a generally planar extension from main body portion 327 and running parallel with respect to a longitudinal axis of first rebar 322 and extending across a full diameter of first rebar 322. Additionally, projection 338 may include, on each of two opposing longitudinal sides thereof, a corrugated external profile that serves in an interlocking, form-fit connection as detailed herebelow. "Generally planar" may be understood as a very rough, rectilinear bar shape with an elongated longitudinal dimension defined in parallel to a central longitudinal axis of the first rebar 322, a width dimension defined in parallel to the aforementioned full diameter and a thickness dimension defined in perpendicular to the width dimension and to the central longitudinal axis. The "generally planar" rectilinear shape may also be understood here as including surface perturbations in the form of the corrugated external profile on each of the two opposing longitudinal sides of projection 338.

Figure 3B:
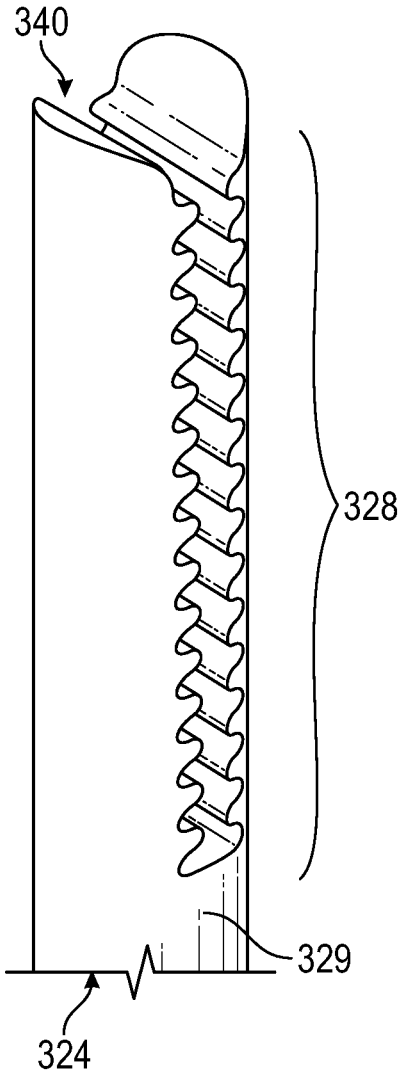
FIG. 3B provides an isometric elevational view of a working example of a second rebar which is interconnectable with the first rebar of FIG. 3A, in accordance with one or more embodiments.

FIG. 3B provides an isometric elevational view of a working example of a second rebar 324 which is interconnectable with the first rebar 322 of FIG. 3A, in accordance with one or more embodiments. As shown, second rebar 324 includes a machined extremity 328 characterized primarily by a recess (or female portion) 340. Recess 340, as shown, extends longitudinally toward a main body portion 329 of second rebar 324. Generally, recess 340 is embodied as a slot portion running toward main body portion 329 and in parallel with respect to a longitudinal axis of second rebar 324, also extending across a full diameter of second rebar 324. Additionally, recess 340 may include, on each of two opposing longitudinal sides thereof, a corrugated internal profile that serves in an interlocking, form-fit connection as detailed herebelow.

Figure 3C:
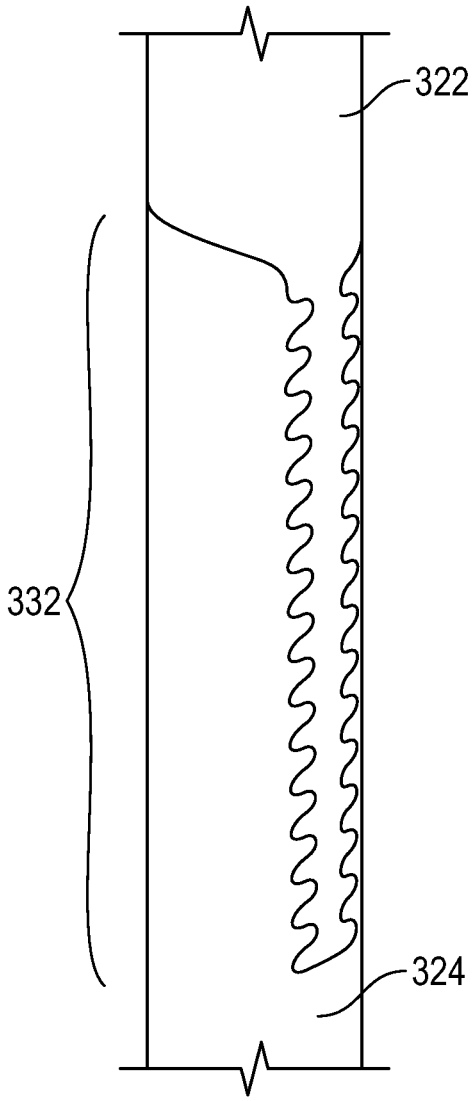
FIG. 3C provides an isometric elevational view of the interconnection of the two rebars from FIGS. 3A and 3B, in accordance with one or more embodiments.

FIG. 3C provides an isometric elevational view of the interconnection of the two rebars from FIGS. 3A and 3C, in accordance with one or more embodiments. As such, FIG. 3C shows the extremities of rebars 322 and 324 interconnected through a region of interconnection 332, where the aforementioned corrugated profiles are physically engaged in a form-fit connection with one another, wherein the form-fit connection prevents separation of the extremities of the rebars 322, 324 and inhibits axial displacement of the rebars 322, 324 with respect to each other. Because the extremities of the rebars 322, 324 are essentially interlocked, no gap is needed between the corrugated portions. However, a non-zero gap or tolerance (e.g., of about 1 mm or even considerably less) may be included to facilitate interconnecting the rebars 322, 324 manually (e.g., along a side-to-side or radial direction as aforementioned).

Figure 4A:
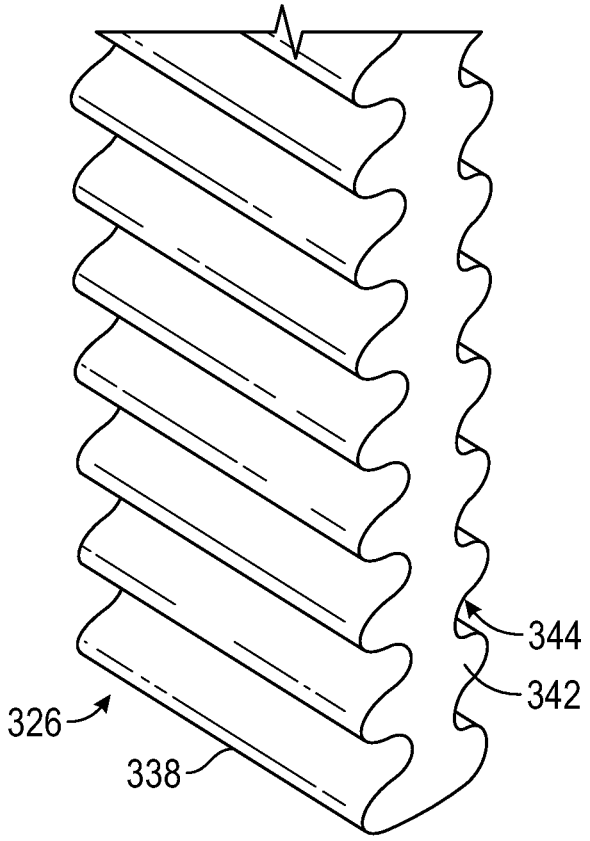
FIG. 4A provides a close-up, isometric elevational view of the first rebar extremity from FIG. 3A, in accordance with one or more embodiments.

FIG. 4A provides a close-up, isometric elevational view of the first rebar extremity 326 from FIG. 3A, in accordance with one or more embodiments. As shown, the corrugated external profile on each longitudinal side of projection 338 may be embodied by a sine-wave profile which includes alternating peaks 342 and valleys 344.

Figure 4B:
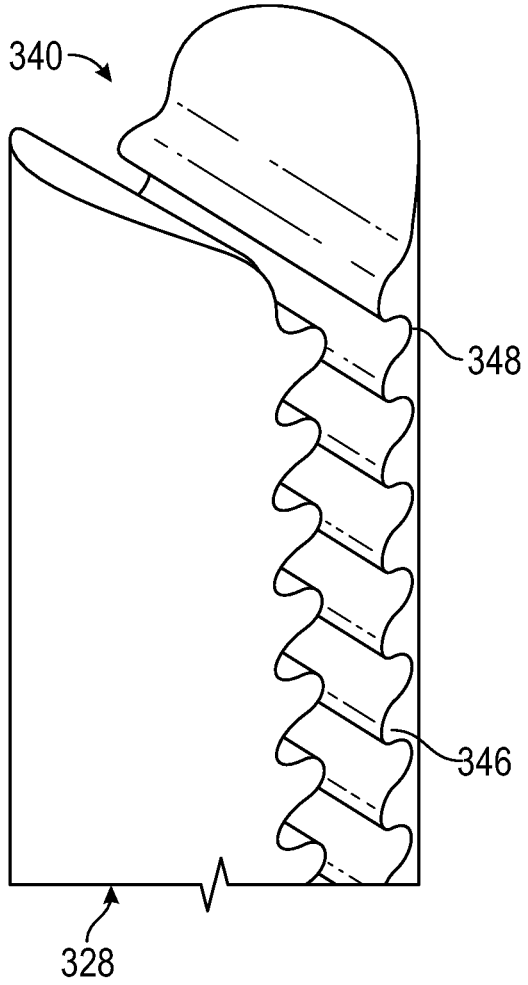
FIG. 4B provides a close-up, isometric elevational view of the second rebar extremity from FIG. 3B, in accordance with one or more embodiments.

In a similar vein, FIG. 4B provides a close-up, isometric elevational view of the second rebar extremity 328 from FIG. 3B, in accordance with one or more embodiments. As shown, the corrugated internal profile on each longitudinal side of recess may be embodied by a sine-wave profile which includes alternating peaks 346 and valleys 348. Further, the internal sine-wave profiles of recess 340 may be fully compatible with the external sine-wave profiles of projection 338 from FIG. 4A.

In accordance with one or more embodiments, alternatives to a sine-wave profile (internal or external) could be provided for rebar extremities 326, 328. However, a sine-wave profile can be advantageous as it minimizes the inclusion of edges, and thus the development of stress concentrations susceptible that may potentially decrease the strength of the interconnection between rebars 322, 324 (e.g., in comparison with a square-wave profile on each rebar extremity 326, 328). Further, a sine-wave profile provides a significant degree of contact (between rebar extremities 326, 328) in a normal (radial) direction with respect to the longitudinal axis of the rebars 322, 324, in addition to contact along the axial direction. Thus, the significant degree of contact in both directions (radial and axial) helps significantly both in preventing separation of the rebar extremities 326, 328 and in inhibiting axial displacement of the two rebars 322, 324 with respect to each other.

In accordance with one or more embodiments, in order to help balance the relative strength of the two extremities 326, 328 with respect to each other, each extremity 326, 328 may have a cross-sectional area, constituted by solid material, that is approximately half of that of a cross-sectional area of the main body portion of a rebar.

Figure 5A:
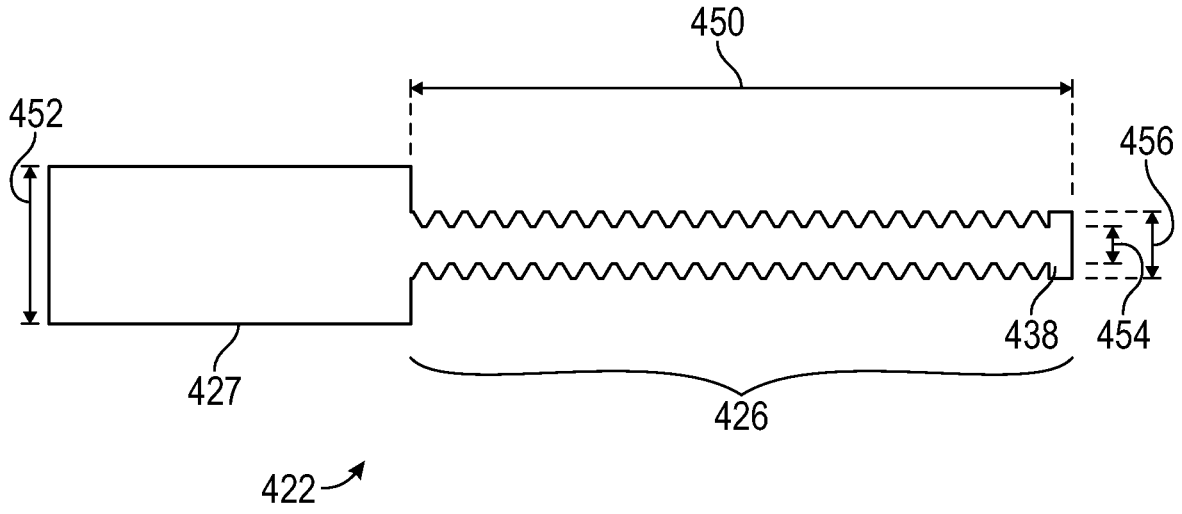
FIGS. 5A and 5B, respectively, schematically illustrate working examples of first and second rebars in side elevational view, along with associated dimensions, in accordance with one or more embodiments.
Figure 5B:
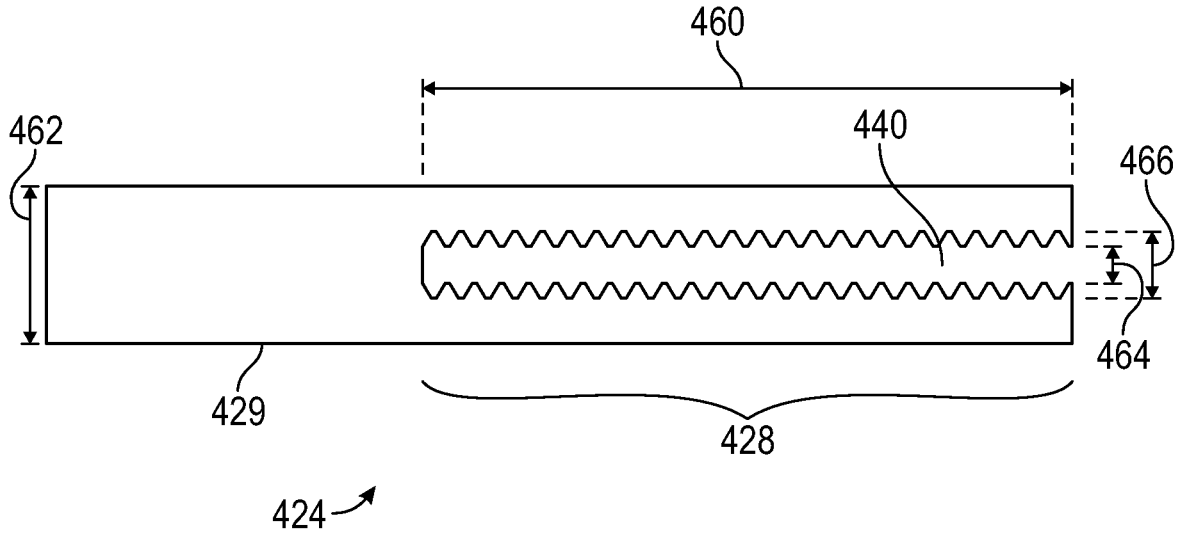

FIGS. 5A and 5B, respectively, schematically illustrate working examples of first and second rebars 422, 424 in side elevational view, along with associated dimensions, in accordance with one or more embodiments. The first and second rebars 422, 424 may correspond to the first and second rebars 322, 324 described and illustrated herein with relation to FIGS. 3A-4B, or to any other rebars broadly described and contemplated herein. Reference may continue to be made to both FIGS. 5A and 5B simultaneously.

In accordance with one or more embodiments, first rebar 422 includes a machined extremity 426 characterized primarily by a projection (or male portion) 438 extending longitudinally away from main body portion 427 of the first rebar 422. As with the example of FIG. 3A, projection 438 is embodied as a generally planar extension from main body portion 427 and running parallel with respect to a longitudinal axis of first rebar 422 and extending across a full diameter of first rebar 422. Projection 338 includes, on each of two opposing longitudinal sides thereof, a corrugated external profile embodied as a sine-wave profile with alternating peaks and valleys. The number of peaks and valleys shown in FIG. 5A is provided merely as a non-restrictive example.

Additionally, in accordance with one or more embodiments, second rebar 424 includes a machined extremity 428 characterized primarily by a recess (or female portion) 440. As with the example of FIG. 3B, recess 440 is embodied as a slot portion running toward main body portion 429 and in parallel with respect to a longitudinal axis of second rebar 424, also extending across a full diameter of second rebar 424. Recess 440 includes, on each of two opposing longitudinal sides thereof, a corrugated internal profile embodied as a sine-wave profile with alternating peaks and valleys. The internal profile of recess 440 may be understood as being physically compatible with the external profile of projection 448; as such, the number of peaks and valleys shown in FIG. 5B is also provided merely as a non-restrictive example.

In accordance with one or more embodiments, per the working example of FIGS. 5A and 5B, an overall length 450 of protrusion 438, and likewise an overall length 460 of recess 440, may be about 71 mm for rebars 422, 424 having an overall diameter (452 and 462, respectively) of about 16 mm. Though the number of peaks and valleys for the sine-wave profile at either opposing (longitudinal) side of protrusion 438 and recess 440 may be chosen as deemed most suitable for the application(s) at hand, there may be 15, 16 or 17 or more peaks and/or valleys in each case. As such, for protrusion 438, a radial peak-to-peak dimension 456 in its sine-wave profile may be about 7.0 mm, and a radial valley-to-valley dimension 454 may be about 4.0 mm. Also, for recess 440, a radial valley-to-valley dimension 466 in its sine-wave profile may be about 7.2 mm, and a radial peak-to-peak dimension 464 may be about 4.2 mm. The differences here in radial dimensions for the sine-wave profiles of protrusion 438 and recess 440 may represent a suitable non-zero gap or tolerance to facilitate interconnecting the rebars 422, 424 manually (e.g., along a side-to-side or radial direction as aforementioned).

Figure 6:
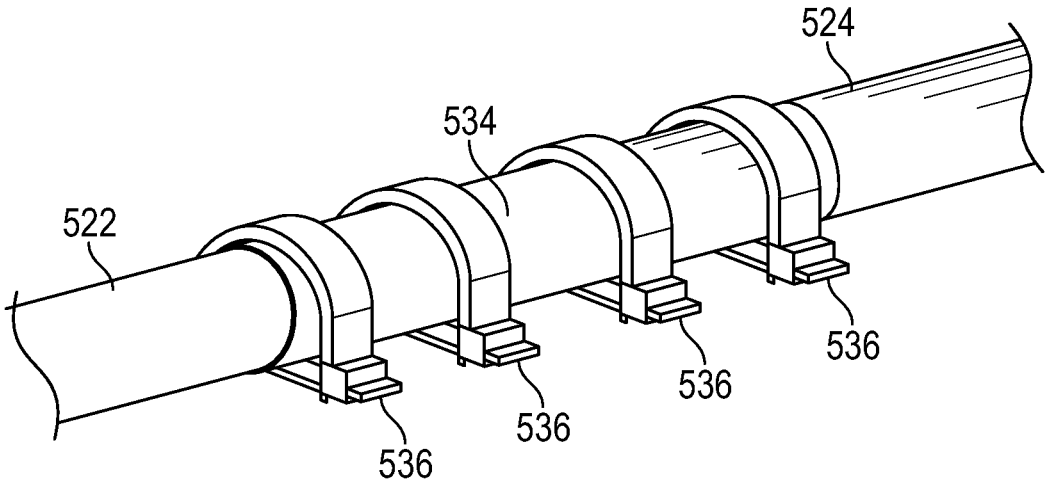
FIG. 6 provides an isometric elevational view of two interconnected rebars with a covering about the rebar extremities, in accordance with one or more embodiments.

FIG. 6 provides an isometric elevational view of two interconnected rebars 522, 524 with a covering 534 about the rebar extremities, in accordance with one or more embodiments. Particularly, a covering in the form of a tubular sleeve 534 may be disposed about extremities of the two rebars 522, 524 (i.e., about a region of interconnection of the extremities), when the extremities (hidden from view in the figure) are interconnected via an interlocking, form-fit connection. Additionally, clamping elements in the form of fasteners 536 may be disposed to surround and clamp the sleeve 534 about a region of interconnection of the extremities of the first and second rebars 522, 524.

In accordance with one or more embodiments, the first and second rebars 522, 524 may be formed from an FRP material, while the sleeve 534 may be formed from an FRP material which is stronger than that of each of the rebars 522, 524. As such, in order to help ensure radial and axial strength and stiffness, the sleeve 534 can exhibit a high modulus and strength in the axial direction of the fiber (of its FRP material). Therefore, the sleeve 534 may be embodied by a unidirectional fiber-reinforced structure. In this connection, the low transverse stiffness of the material would permit constricting the sleeve 534 about the extremities of the rebars 522, 524 without appreciably inviting a risk of forming cracks in the sleeve. Further, the thickness of the sleeve 534 is a parameter that can be tailored in order to adjust the amount of required load to transfer from one of the rebars 522, 524 to the other. If the required load to transfer is sufficiently high as to warrant a thickness of sleeve 534 that itself necessitates an appreciably high tightening force (via clamping elements 536), then one or more several axial cuts at each end of the sleeve 534 could provide some circumferential flexibility and decrease the required torque to tighten the sleeve 534 around the rebars 522, 524.

Figure 7:
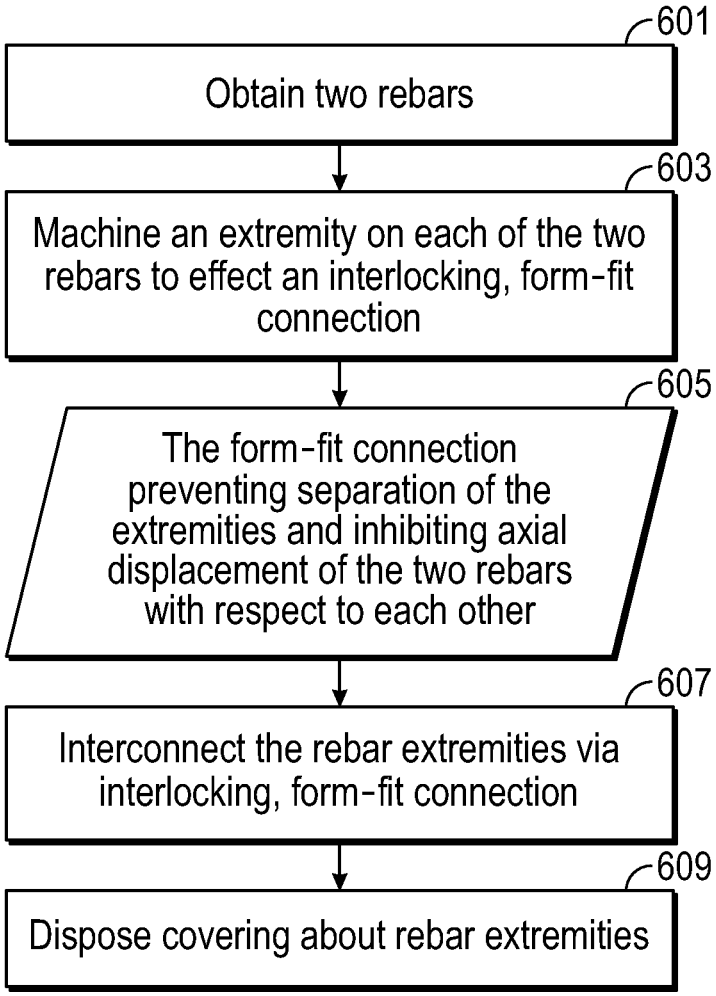
FIG. 7 shows a flowchart of a method in accordance with one or more embodiments.

It can be appreciated from the foregoing that, in accordance with one or more embodiments, methods of mechanically coupling two rebars are broadly contemplated, as illustrated in the flowchart of FIG. 7. With simultaneous reference to general components illustrated in FIGS. 2A-2C, in at least one conceivable method, two rebars 222, 224 are obtained (601), and an extremity (226 and 228, respectively) on each of the two rebars 222, 224 is machined to effect an interlocking, form-fit connection between the two rebars (603), where the form-fit connection prevents separation of the extremities 226, 228 and inhibits axial displacement of the two rebars 222, 224 with respect to each other (605). The rebar extremities 226, 228 are interconnected via the interlocking, form-fit connection (607), and a covering 234 is thereafter disposed about the rebar extremities (609).

As can be appreciated from the foregoing by a person of ordinary skill, in accordance with one or more embodiments, there is broadly contemplated herein a mechanical connection where two rebars are interconnected with no increase in cross-sectional area along a region of interconnection, while being joined with a double mechanical system including an interlocking design and a tightening mechanism. The interlocking design includes complementary male and female machined portions at the extremity of each rebar.

Further, it can be appreciated that, in accordance with one or more embodiments, there is a "synergistic" effect provided via a strong tightening mechanism and effective anti-slip (interlocking) mechanism. Particularly, the mere physical interlocking of rebar extremities may not be solely sufficient for transferring tensile/axial loads applied to the rebars, while such interlocking as contemplated herein indeed is highly effective in inhibiting relative axial displacement of the rebars and even preventing separation of the rebar extremities. A covering or sleeve, as broadly contemplated herein, then is applied to absorb the great majority of tensile/axial loads applied to the rebars (e.g., between about 70% and about 90% of such loads). At the same time, though, with relative axial slip of the rebars prevented via the interlocking connection, the tightening force applied by the covering/sleeve and clamping elements remains completely (or virtually completely) radial in orientation.

Generally, it can be appreciated from the foregoing that among the advantages afforded by one or more embodiments as broadly contemplated herein, there is a minimization of any tensile and shear load that may be transferred through surrounding concrete, as normally would be the case with conventional interconnection techniques such as lap splicing. Instead, such loads are transferred largely through the mechanical connection involving the rebar extremities, the covering and the clamping elements. Such a connection also averts the use of use of any grout, which decreases the weight of the connection. Moreover, the use of a ready-made covering/sleeve (e.g., formed from FRP) can help decrease overall assembly time without sacrificing any mechanical properties, compared to any structural adhesives that may be used in certain patching technologies.

Additionally, in accordance with one or more embodiments, it should be appreciated that with the co-axial arrangement of two rebars as afforded by the interlocking connection and covering/clamping broadly contemplated herein, an effect of physical "congestion" is greatly reduced in comparison with a lap splicing arrangement. Thus, in comparison with lap splicing, concrete being poured will flow much more easily for cast-in-place purposes.

Among other advantages afforded in accordance with one or more embodiments, as broadly contemplated herein, a mechanical connection can impart a strength that is significantly higher than that afforded by the rebars themselves (e.g., about 115% of the rebar strength itself), thus keeping regions outside of the connection below a maximum strain value of the rebar material.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures.

Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A mechanical coupling for two fiber-reinforced polymer (FRP) rebars, the coupling comprising:

a first extremity disposed on a first of the two FRP rebars, and a second extremity disposed on a second of the two FRP rebars;

each of the first and second extremities being machined to effect an interlocking, form-fit connection between the two FRP rebars, wherein the form-fit connection prevents separation of the first and second extremities and inhibits axial displacement of the two FRP rebars with respect to each other;

a non-metallic sleeve disposed about the two extremities when the extremities are interconnected via the interlocking, form-fit connection, wherein the sleeve is formed from a material which is stronger than a material forming each of the first and second rebars; and one or more clamps disposed to clamp about the sleeve at the first and second extremities;

wherein the sleeve, when clamped, absorbs a majority of a tensile load applied to the first and second rebars.

2. The mechanical coupling according to claim 1, wherein the first and second extremities combine to form a region of interconnection with a substantially constant outer diameter.

3. The mechanical coupling according to claim 2, wherein:

each of the first and second rebars includes a main body portion, wherein the first extremity extends away from the main body portion of the first rebar and the second extremity extends away from the main body portion of the second rebar; and the substantially constant outer diameter is substantially equivalent to an outer diameter of the main body portion of each of the first and second rebars.

4. The mechanical coupling according to claim 1, wherein, when interconnected, the first and second extremities:

combine to form a region of interconnection; and are coaxial with respect to one another through the region of interconnection.

5. The mechanical coupling according to claim 4, wherein:

each of the first and second rebars includes a main body portion, wherein the first extremity extends away from the main body portion of the first rebar and the second extremity extends away from the main body portion of the second rebar;

the first extremity includes a projection which extends away from the main body portion of the first rebar and in parallel with respect to a longitudinal axis of the first rebar; and the second extremity includes a recess which structurally accommodates the projection of the first extremity and extends in parallel with respect to a longitudinal axis of the second rebar.

6. The mechanical coupling according to claim 5, wherein:

the projection extends across a full diameter of the first rebar; and the recess comprises a slot portion which extends across a full diameter of the second rebar.

7. The mechanical coupling according to claim 5, wherein:

the projection includes a first external surface and a second external surface which face away from each other, and a corrugated external profile disposed on at least one of the first and second external surfaces; and the recess of the second extremity includes a first internal surface and a second internal surface which face toward each other, and a corrugated internal profile disposed on at least one of the first and second internal surfaces;

wherein the corrugated external profile and the corrugated internal profile physically engage with one another to inhibit axial displacement of the rebars with respect to each other.

8. The mechanical coupling according to claim 7, wherein the corrugated external profile and the corrugated internal profile each comprise a sine-wave profile.

9. A method comprising:

obtaining two fiber-reinforced polymer (FRP) rebars;

machining an extremity on each of the two rebars to effect an interlocking, form-fit connection between the two rebars, wherein the form-fit connection prevents separation of the extremities and inhibits axial displacement of the two rebars with respect to each other;

interconnecting the rebar extremities via the interlocking, form-fit connection;

thereafter disposing a non-metallic sleeve formed from a material that is stronger than a material forming each of the first and second rebars about the rebar extremities; and clamping the sleeve at the first and second extremities such that the sleeve absorbs a majority of a tensile load applied to the first and second rebar.

10. The method according to claim 9, wherein the extremities of the rebars combine to form a region of interconnection with a substantially constant outer diameter.

11. The method according to claim 9, wherein, when interconnected, the extremities of the two rebars:

combine to form a region of interconnection; and are coaxial with respect to one another through the region of interconnection.

12. The method according to claim 11, wherein said machining comprises:

machining a first extremity, on a first of the two rebars, to include a projection which extends away from a main body portion of the first rebar and in parallel with respect to a longitudinal axis of the first rebar; and machining a second extremity, on a second of the two rebars, to include a recess which structurally accommodates the projection of the first extremity and extends in parallel with respect to a longitudinal axis of the second rebar.

13. The method according to claim 12, wherein:

the projection extends across a full diameter of the first rebar; and the recess comprises a slot portion which extends across a full diameter of the second rebar.

* * * * *